US011649757B2

(12) United States Patent
Dods et al.

(10) Patent No.: US 11,649,757 B2
(45) Date of Patent: May 16, 2023

(54) PASSIVE PISTON COOLING NOZZLE CONTROL WITH LOW SPEED HOT RUNNING PROTECTION

(71) Applicant: Cummins Inc., Columbus, IN (US)

(72) Inventors: James A. Dods, Stainton Grove (GB); Nathaniel P. Hassall, Beijing (CN); Adam C. Cecil, Columbus, IN (US); Aaron S. Quinton, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/648,733

(22) Filed: Jan. 24, 2022

(65) Prior Publication Data

US 2022/0145791 A1 May 12, 2022

Related U.S. Application Data

(63) Continuation of application No. PCT/US2020/044966, filed on Aug. 5, 2020.

(60) Provisional application No. 62/884,366, filed on Aug. 8, 2019.

(51) Int. Cl.
*F01P 3/06* (2006.01)
*F01P 7/14* (2006.01)

(52) U.S. Cl.
CPC ..... *F01P 3/06* (2013.01); *F01P 7/14* (2013.01); *F01P 2007/146* (2013.01); *F01P 2025/04* (2013.01); *F01P 2025/60* (2013.01)

(58) Field of Classification Search
CPC ..... F01P 3/06; F01P 7/14
See application file for complete search history.

(56) References Cited

U.S. PATENT DOCUMENTS

| | | | | |
|---|---|---|---|---|
| 3,453,995 A | | 7/1969 | Pelizzoni et al. | |
| 3,709,109 A | | 1/1973 | Howe | |
| 4,114,571 A | | 9/1978 | Ruf | |
| 4,284,174 A | | 8/1981 | Salvana et al. | |
| 4,876,990 A | * | 10/1989 | Hodgkins | F01P 3/08 123/41.35 |
| 5,355,856 A | * | 10/1994 | Paul | F02M 45/10 123/446 |
| 5,533,472 A | | 7/1996 | Sands et al. | |

(Continued)

FOREIGN PATENT DOCUMENTS

| | | |
|---|---|---|
| DE | 3637196 A1 | 5/1988 |
| EP | 3488090 A1 | 5/2019 |

(Continued)

OTHER PUBLICATIONS

Indian Patent Office, Indian Examination Report issued in corresponding Indian Application No. 202247005787, dated Nov. 9, 2022, 7 pgs.

(Continued)

*Primary Examiner* — Long T Tran
(74) *Attorney, Agent, or Firm* — Taft, Stettinius & Hollister LLP

(57) ABSTRACT

Systems and devices are disclosed for controlling fluid flow to piston cooling nozzles with a fluid flow control device configured to open when an internal combustion engine requires piston cooling at high speed but remains open for a period of time after the engine speed drops below a threshold to prevent heat soak damage to the pistons.

20 Claims, 6 Drawing Sheets

(56) References Cited

U.S. PATENT DOCUMENTS

| | | | | |
|---|---|---|---|---|
| 5,685,490 | A * | 11/1997 | Ausman | F02M 57/025 239/533.9 |
| 7,350,484 | B2 | 4/2008 | Bontaz et al. | |
| 8,997,698 | B1 | 4/2015 | Roth et al. | |
| 9,828,900 | B2 | 11/2017 | Takasaki et al. | |
| 9,885,274 | B2 | 2/2018 | Sato | |
| 2004/0026174 | A1 | 2/2004 | Lauritsen | |
| 2005/0072476 | A1* | 4/2005 | Neto | F16K 15/025 137/539 |
| 2009/0236445 | A1* | 9/2009 | Lintern | B05B 11/3018 222/491 |
| 2011/0283968 | A1* | 11/2011 | Anderson | F01M 1/08 123/196 R |
| 2015/0240699 | A1 | 8/2015 | Candela et al. | |
| 2016/0290188 | A1* | 10/2016 | Gokan | F01M 1/08 |
| 2017/0284277 | A1* | 10/2017 | Wardle | F01M 1/16 |
| 2018/0126405 | A1 | 5/2018 | Ogino et al. | |
| 2018/0363537 | A1* | 12/2018 | Mark | B05B 1/302 |
| 2019/0107033 | A1 | 4/2019 | Malischewski et al. | |

FOREIGN PATENT DOCUMENTS

| | | | |
|---|---|---|---|
| JP | 2010174824 | A | 8/2010 |
| JP | 2010236438 | A | 10/2010 |
| JP | 04599785 | B2 | 12/2010 |
| JP | 2014009669 | A | 1/2014 |
| JP | 06288435 | B2 | 3/2018 |
| SU | 1193277 | A2 | 11/1985 |

OTHER PUBLICATIONS

International Search Report and Written Opinion, PCT Appln. No. PCT/US20/44966, dated Oct. 26, 2020, 9 pgs.

* cited by examiner

PASSIVE PISTON COOLING NOZZLE CONTROL WITH LOW SPEED HOT RUNNING PROTECTION

CROSS-REFERENCE TO RELATED APPLICATION

This application is a continuation of International PCT Application No. PCT/US20/44966 filed on Aug. 5, 2020, which claims the benefit of the filing date of U.S. Provisional Application 62/884,366 filed on Aug. 8, 2019, each of which are incorporated herein by reference in their entirety for all purposes.

FIELD OF THE DISCLOSURE

The present disclosure relates generally to internal combustion engines, and more particularly, but not exclusively, to a piston cooling system having a passive fluid flow control device with low speed hot running protection.

BACKGROUND

Generally, fluid flow control devices have been used in internal combustion engines to control the flow of oil and other cooling fluids to provide cooling of one or more components of the engine. For example, piston cooling nozzles can be supplied with cooling fluid to be sprayed onto the underside of the piston to provide cooling at higher engine speeds. For passively controlled piston cooling nozzles, when the engine speed drops below a threshold speed, the supply of cooling fluid is stopped. However, the drop in temperature of the piston does not correspond identically with the drop in engine speed. Therefore, due to this heat soak of the pistons while the engine is running at lower speeds, damage may result to the pistons since cooling fluid is not supplied while the pistons are at higher temperatures. As such, there exists a need for improvement in fluid flow control devices for cooling of pistons in an internal combustion engine.

SUMMARY

The present disclosure includes a unique system and/or apparatus for cooling pistons in an internal combustion engine. The piston cooling system includes a reservoir from which fluid is fed and a piston cooling nozzle coupled to the reservoir and configured to direct the fluid fed from the reservoir for spraying the fluid onto a piston in the engine. The piston cooling system includes a fluid flow control device that connects the reservoir and the piston cooling nozzle. In one embodiment, the fluid flow control device includes a first chamber that opens to allow the fluid to pass from the reservoir to the piston cooling nozzle in response to the engine speed exceeding a first threshold. The fluid flow control device also includes a second chamber in fluid communication with the first chamber for receiving fluid fed from the first chamber through a check valve between the first and second chambers in response to the fluid flow control device being opened. At least one of the fluid flow control device and the check valve includes a clearance to bleed fluid from the second chamber into the reservoir to delay a closing of the fluid flow control device and allow cooling fluid to continue to be supplied for a predetermined period of time in response to the engine speed dropping below the first threshold.

Another embodiment includes a piston cooling nozzle device for controlling a flow fluid used for cooling pistons in an internal combustion engine. The device includes a fluid flow control device having a first chamber and a second chamber for housing fluid and configured to control the fluid flow between the first and second chambers. The fluid flow control device can include a check valve between the first and second chambers to regulate fluid flow from the first chamber into the second chamber as a fluid flow path to the piston cooling nozzle is opened in response to the engine speed being above a threshold. The fluid flow control device includes a clearance to bleed fluid from the second chamber into the first chamber to delay a closing of the fluid flow path in response to the engine speed dropping below the threshold.

This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The description herein makes reference to the accompanying drawings wherein like numerals refer to like parts throughout the several views, and wherein.

DETAILED DESCRIPTION OF ILLUSTRATIVE EMBODIMENTS

For the purposes of clearly, concisely and exactly describing illustrative embodiments of the present disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

The present disclosure relates to a piston cooling system having a mechanically controlled fluid flow control device configured to open when an internal combustion engine requires piston cooling at high speed and then remaining open for a period of time after the engine speed drops below a threshold to prevent heat soak damage to the pistons.

Figure 1:
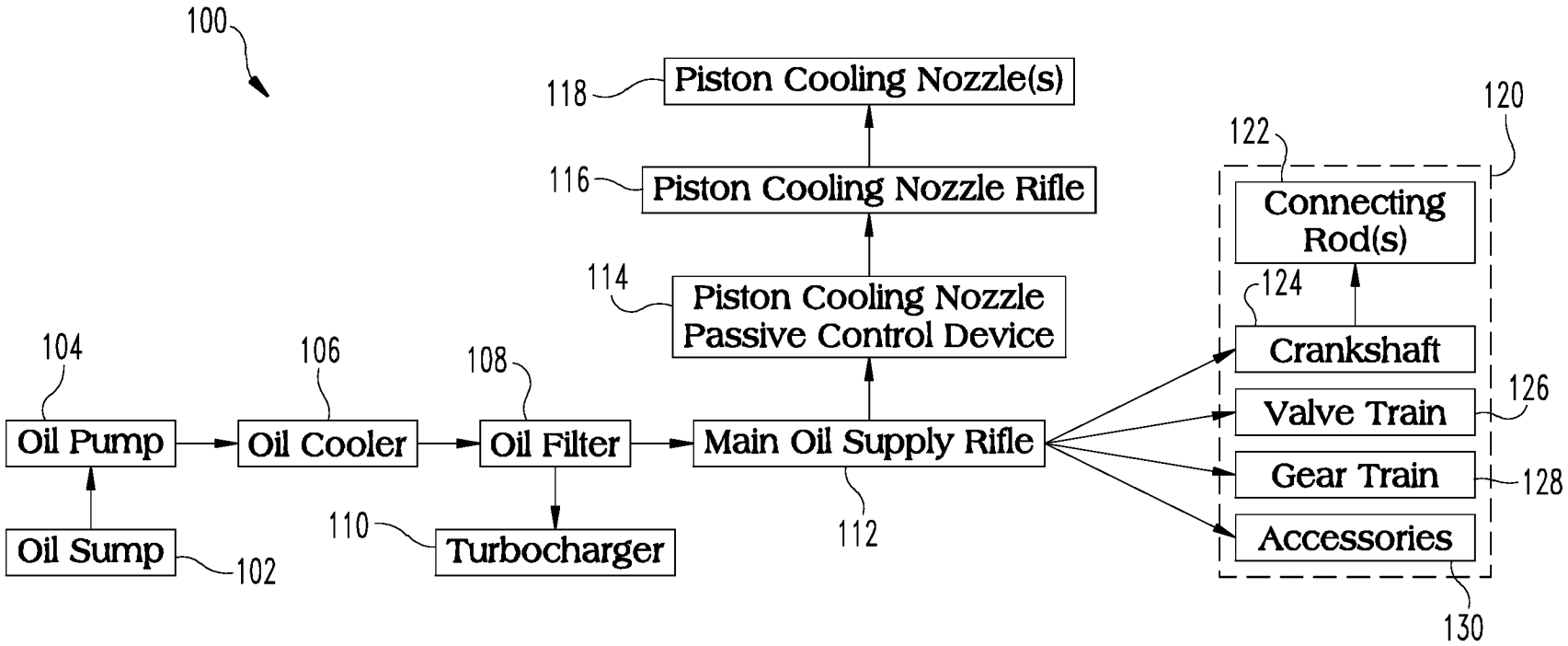
FIG. 1 is a schematic block diagram of an example engine lubrication system having a fluid flow control device, according to an embodiment of the present disclosure.

Referring to FIG. 1, a schematic block diagram of an example engine lubrication system 100 for an engine 120.

The system 100 may include a sump 102 that contains engine oil or other fluid for lubricating and/or cooling the engine. The system 100 may also include a pump 104 to extract fluid from the sump 102 before the fluid is cooled by a cooler 106, which may generally be used to remove surplus heat from the engine to use the fluid as a coolant. After the fluid is cooled, the fluid may be filtered in a filter 108 to remove any contaminants from the fluid. As shown in FIG. 1, the system 100 may optionally include a turbocharger 110. The system 100 may further include a main fluid supply rifle 112 that is supplied fluid from the pump 104 and coupled to a piston cooling nozzle rifle 116 that provides the fluid to be sprayed via one or more piston cooling nozzles 118 onto one or more pistons of the engine 120.

In an example embodiment, the system 100 may include a piston cooling nozzle passive fluid flow control device 114 to mechanically control the fluid flowing from the main fluid supply rifle 112 and direct the fluid to the piston cooling nozzle rifle 116. It should be appreciated that fluid can be supplied to various components of the internal combustion engine as shown in FIG. 1 such as, for example, connecting rods 122, crankshaft 124, valve train 126, gear train 128, and other accessories 130 (not listed).

Figure 2:
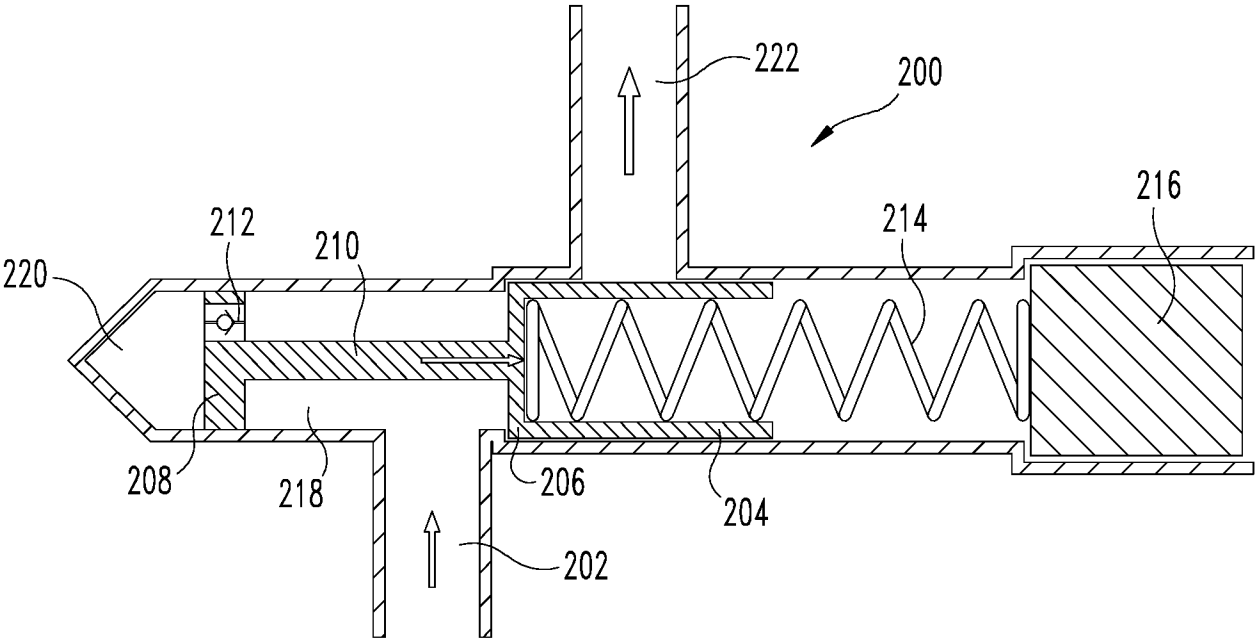
FIG. 2 is a section view of the fluid flow control device in a closed position at a low engine speed.

Referring to FIG. 2, an embodiment of the fluid flow control device 114 is shown and designated at 200. Fluid flow control device 200 may be coupled at one end to a fluid feed inlet 202. The fluid feed inlet 202 may be, for example, a reservoir or passage that is connected to a main fluid supply such as fluid supply rifle 112 of FIG. 1.

In an example embodiment, the fluid flow control device 200 may include a plunger 204 housed in a fluid flow passage between the main fluid supply rifle 112 and the piston cooling nozzle rifle 116. The plunger 204 is passively controlled to move to open and close a fluid flow path between the fluid feed inlet 202 and piston cooling nozzles 118 in response to engine speed. As the engine speed increases, the fluid pressure increases to act on and displace the plunger 204 to open the normally closed fluid flow path. As the engine speed decreases, the fluid pressure is reduced to allow the plunger 204 to return to its normally closed position and close the fluid flow path.

The plunger 204 may include a body 206 at one end and a base 208 at the other end. The plunger 204 includes a stem 210 that extends from the base 208 to the body 206 and separates the base 208 from the body 206. The fluid flow control device 200 may include a one-way fluid flow control device such as a check valve 212 to allow fluid (e.g., oil) to flow only or primarily in one direction through base 208 of the plunger 204. In the example embodiment, the check valve 212 is housed in the base 208 of the plunger 204, but other arrangements and locations for check valve 212 are not precluded. In any embodiment, the check valve 212 may be provided to allow fluid to flow easily behind the base 208 of the plunger 204.

Fluid flow control device 200 also includes a spring 214 and a plug 216 coupled to the body 206 of the plunger 204. The spring 214, for example, may be configured to apply force onto the body 206 which may normally bias the plunger 204 of fluid flow control device 200 to a closed position, such as shown in FIG. 2.

According to the example embodiment, the fluid flow control device 200 may be configured with a first chamber 218 and a second chamber 220 in fluid communication with one another through the check valve 212. The first and second chambers 218 and 220 are configured to transfer fluid therebetween as the plunger moves to open and close the fluid flow path to the piston cooling nozzles 118. For example, the second chamber 220 may receive fluid fed from the first chamber 218 through the check valve 212 in response to the fluid pressure increasing in the first chamber 218 as the engine speed increases.

According to an aspect of the present disclosure, the fluid flow control device 200 may be passively controlled to open and close in response to fluid pressure that is based on engine speed. In this case, the plunger 204 is configured to selectively open and close the fluid flow path between the fluid feed inlet 202 and piston cooling nozzles 118 in response to the engine speed being above or below a predetermined threshold. In FIG. 2, when the engine is running at a low engine speed below a threshold, fluid pressure (e.g., oil pressure) in the engine may not reach a pressure required to move the plunger 204. Thus, when the engine is not running or runs at a low engine speed, the plunger 204 is normally biased to a closed position in the fluid flow control device 200 and the check valve 212 remains closed. In the closed position, the fluid flow path is closed such that fluid oil is prevented from flowing to the piston cooling nozzles 118 from outlet 222.

Figure 3:
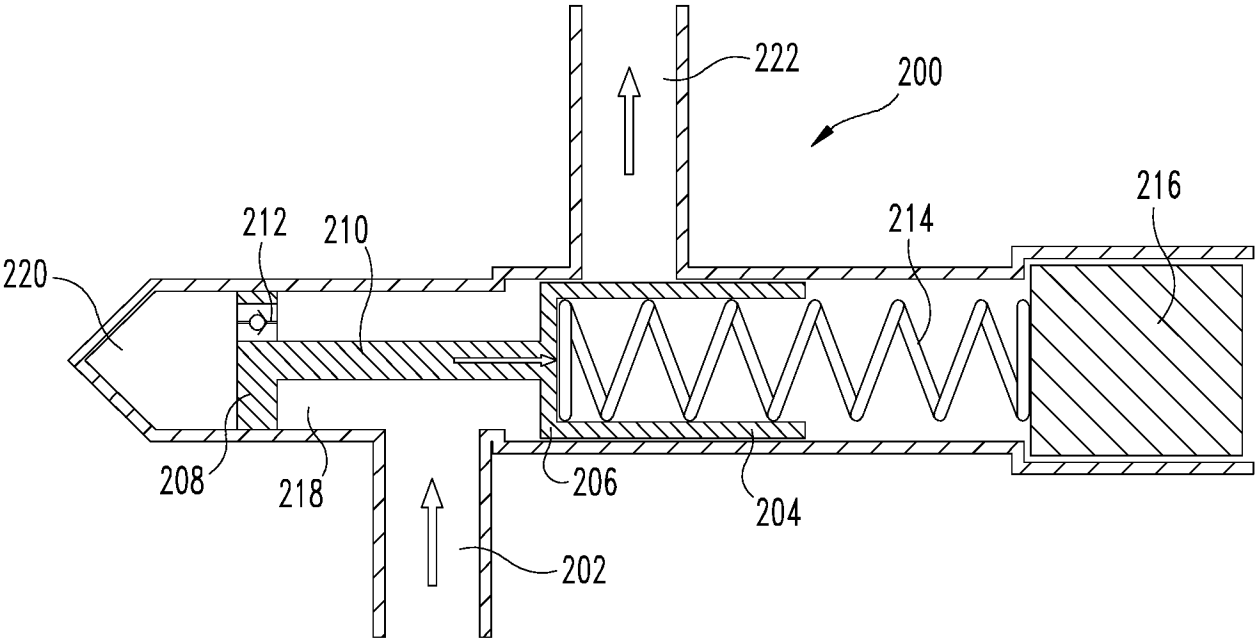
FIG. 3 is a section view of the fluid flow control device starting to move to an open position as the engine speed increases.

Referring to FIG. 3, when the engine is running at a speed that is above a predetermined threshold, fluid pressure (e.g., oil pressure) increases to a pressure required to move the plunger 204 from the closed position toward an open position. The fluid pressure in the first chamber 218 acts on the end area of the body 206 to move the plunger 204 toward the open position (to the right in FIG. 3.) As the plunger 204 starts to move to the open position, the fluid pressure also opens the check valve 212 so that fluid flows into the second chamber 220. The end area of the body 206 is greater than the area of the base 208 so the net force from the fluid pressure causes the plunger 204 to compress the spring 214, overcoming a force biasing the plunger 204 to the closed position. In the example embodiment, fluid may flow from the first chamber 218 through the check valve 212 into the second chamber 220 as the plunger 204 moves from the closed position toward the open position so that the second chamber 220 fluid volume increases.

Figure 4:
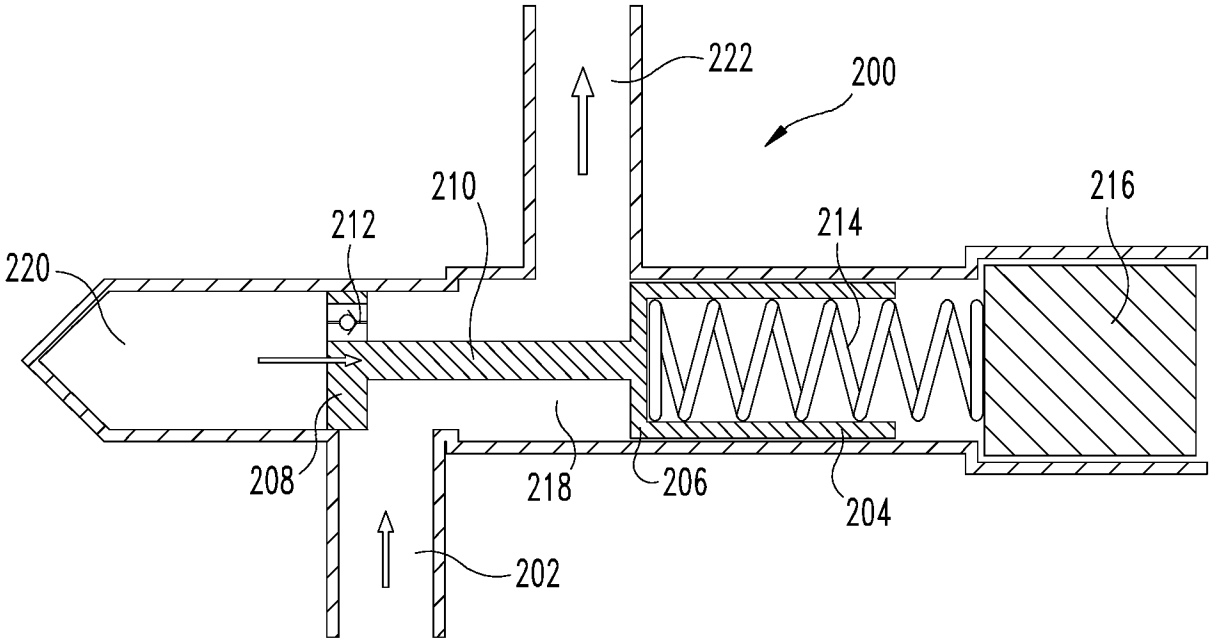
FIG. 4 is a section view of the fluid flow control device in the open position with fluid flow to a piston cooling nozzle.

Referring to FIG. 4, the plunger 204 is moved to the open position so that the fluid flow path is completely open by displacement of the plunger 204. In the open position, the fluid flow path between the fluid feed inlet 202 and the piston cooling nozzles 118 is opened allowing fluid to freely flow from the fluid feed inlet 202 to the outlet 222 for feeding to the piston cooling nozzles 118.

Figure 5:
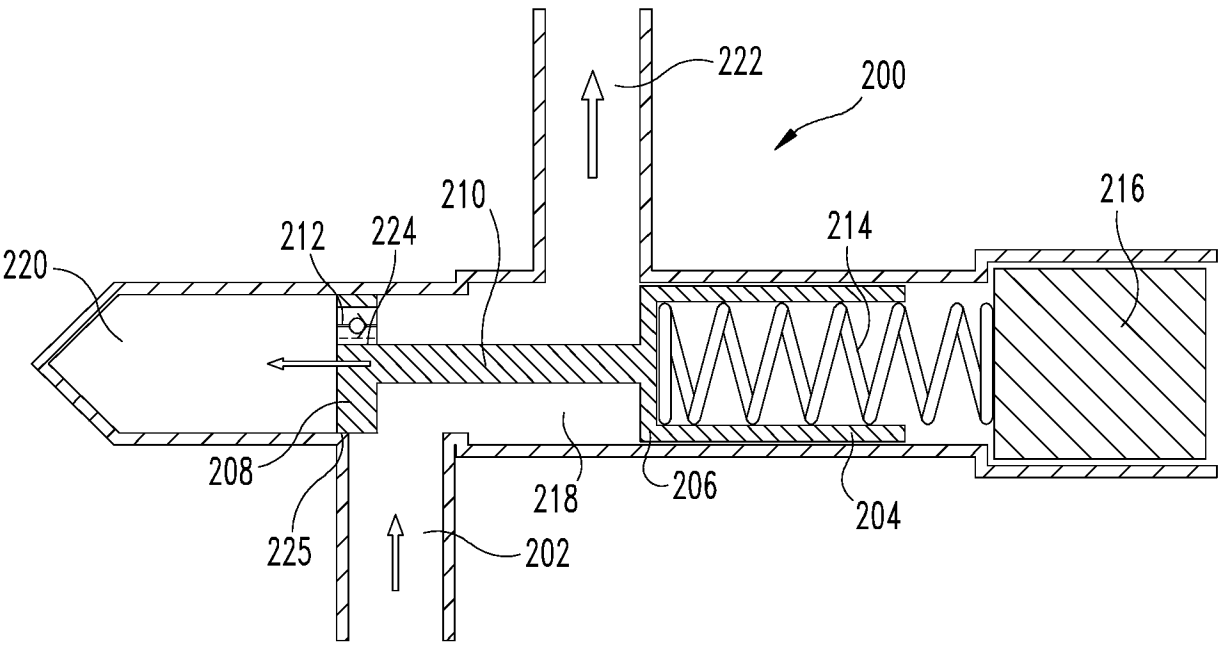
FIG. 5 is a section view of the fluid flow control device moving from the open position toward the closed position in response to the engine speed dropping below a threshold.

Referring to FIG. 5, when the engine speed drops below the predetermined threshold, for example, after running at a high engine speed and dropping to a low engine speed having lower oil pressure, the check valve 212 closes. In this case, the check valve 212 closes and substantially prevents fluid flow from the second chamber 220 into the first chamber 218 except through a controlled clearance 224 of the plunger 204. Therefore, fluid may continue to flow to the piston cooling nozzles 118 even after the engine speed drops below the threshold that forces the plunger 204 to open.

According to an example embodiment, the fluid flow control device 200 may be configured with a clearance 224 that is provided on the check valve 212. The clearance 224 provided on the check valve 212 may be a hole or passage that is sized to allow the fluid to slowly bleed from the second chamber 220 to the first chamber 218 even if the check valve 212 is closed so that the plunger 204 slowly returns to the closed position under the bias of the spring 214.

In yet another example embodiment, the fluid flow control device 200 may be configured with a clearance provided on or around an area that is around the plunger 204. For example, a clearance 225 may be provided around the base 208 between the wall of the cavity or the rifle that houses the plunger 204 and the base 208 so that fluid can flow from the second chamber 220 to the first chamber 218 even if the check valve 212 is closed.

With the clearance 224 provided in the check valve 212 or, alternatively or additionally around the base 208 of the plunger 204 (e.g., clearance 225), the clearance 224 (and alternatively or additionally, the clearance 225) is configured to allow fluid to bleed from the second chamber 220 into the first chamber 218 and the fluid feed inlet 202 to delay the closing of the fluid flow control device 200 for a predetermined period of time in response to the engine speed dropping below the predetermined threshold. As the engine speed drops below the predetermined threshold, the clearance 224 allows the plunger 204 to return to the closed position slowly as oil evacuates the second chamber 220 and bleeds from the outlet 222 to the piston cooling nozzles 118 back into the inlet 202. According to an aspect, for example, the slow return of the plunger 204 to the closed position keeps the fluid flow control device 200 open for a duration after the engine has been running at high temperatures, thus maintaining piston cooling and preventing or reducing piston damage from heat soak.

Figure 6:
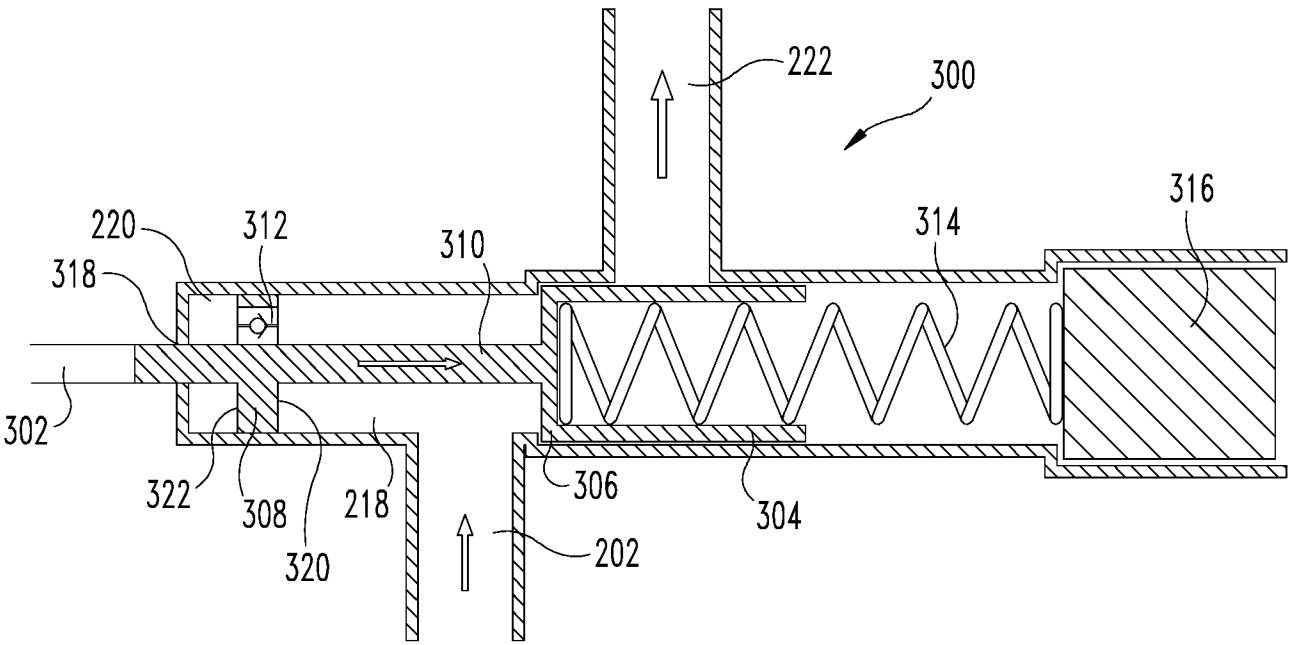
FIG. 6 is a section view of a fluid flow control device, according to an embodiment of the present disclosure.

Referring to FIG. 6, another embodiment fluid flow control device 300 is provided that may be actuated by the intake manifold pressure and/or exhaust manifold pressure. Fluid flow control device 300 includes a plunger 304 housed in the fluid flow passage between the main fluid supply rifle 112 and the piston cooling nozzle 116 (see FIG. 1). The plunger 304 may include a body 306 at one end and a base 308 at the other end. The plunger 304 includes a stem 310 that extends from one side 320 of the base 308 to the body 306 and separates the base 308 from the body 306. At a side 322 of the base 308 opposite the one side 320, the stem 310 extends through an opening 318 of the chamber 220 to an air pressure feed inlet 302 that is connected to a portion of an intake manifold (not shown) and/or exhaust manifold (not shown.)

According to the present disclosure, the fluid flow control device 300 may be passively controlled to open and close in response to air pressure fed from the intake manifold and/or exhaust manifold that increases or decreases in response to engine speed. In the example embodiment, the plunger 304 is configured to selectively open and close the fluid flow path between the fluid feed inlet 202 and piston cooling nozzles 118 in response to the engine speed being above or below a predetermined threshold. As the engine speed increases, air pressure from the inlet 302 increases to act on stem 310 in opening 318 and displace the plunger 304 to open the normally closed fluid flow path. As the engine speed decreases, the air pressure is reduced to allow the plunger 304 to return to its normally closed position and close the fluid flow path in a controlled manner as discussed above. There is a more direct correlation to the intake or exhaust manifold pressure and the engine load as compared to oil pressure. Therefore, this embodiment can provide cooling at high engine speeds and low loads, and also cooling at low engine speeds and high loads.

The fluid flow control device 300 may include a one-way fluid flow control device such as check valve 312 to allow fluid (e.g., oil) to flow only or primarily in one direction through base 308 of the plunger 304. In the example embodiment, the check valve 312 is housed in the base 308 of the plunger 304, but other arrangements and locations for check valve 312 are not precluded. In any embodiment, the check valve 312 may be provided to allow fluid to flow easily behind the base 308 of the plunger 304. Fluid flow control device 300 also includes a spring 314 and a plug 316 coupled to the body 306 of the plunger 304. The spring 314, for example, may be configured to apply force onto the body 306 which may normally bias the plunger 304 of fluid flow control device 300 to a closed position.

Further written description of a number of example embodiments shall now be provided. One embodiment is a piston cooling system for an internal combustion engine, comprising a reservoir from which fluid is fed, a PCN coupled to the reservoir and configured to direct the fluid fed from the reservoir for spraying the fluid onto a piston in the engine, and a fluid flow control device connecting the reservoir and the PCN, the fluid flow control device having a first chamber that opens to allow the fluid to pass from the reservoir to the PCN in response to at least one of an engine speed and an air pressure exceeding a first threshold, the fluid flow control device including a second chamber in fluid communication with the first chamber for receiving fluid fed from the first chamber through a check valve between the first and second chambers in response to the fluid flow control device being opened, wherein at least one of the fluid flow control device and the check valve includes a clearance to bleed fluid from the second chamber into the reservoir to delay a closing of the fluid flow control device for a predetermined period of time in response to the one of the engine speed and the air pressure dropping below the first threshold.

In certain forms of the foregoing system, the fluid flow control device includes a plunger that is movable to selectively open and close a fluid flow path between the reservoir and the PCN in response to the one of the engine speed and the air pressure being above and below the threshold. In certain forms, the plunger includes a base that separates the first and second chambers and the check valve is housed in the base.

In certain forms, the plunger includes a stem extending from the base to a body that is spaced from the base, and the first chamber is defined between the body and the base. In certain forms, the plunger is housed in a passage between a main oil supply rifle and a PCN rifle of the internal combustion engine. In certain forms, the plunger is normally biased to a closed position that closes the fluid flow path.

In certain forms, the plunger is movable from the closed position to an open position in response to a fluid pressure in the first chamber acting on the body that overcomes a force biasing the plunger to the closed position. In certain forms, fluid flows from the first chamber through the check valve and into the second chamber as the plunger moves from the closed position to the open position.

In certain forms, in response to the one of the engine speed and the air pressure dropping below the first threshold, the fluid flow control device is configured such that the fluid in the second chamber bleeds through the clearance to maintain the fluid flow control device open for a period of time after the engine speed drops below the first threshold. In certain forms, the fluid flow control device is passively controlled in response to fluid pressure that is based on engine speed. In certain forms, in response to the one of the engine speed and the air pressure dropping below the first threshold, the check valve is configured to close and substantially prevent fluid flow from the second chamber into the first chamber through the check valve. In certain forms, the clearance is located on the check valve and is a hole through the check valve having a predetermined size. In certain forms, the clearance is located around the plunger between the plunger and a wall around the plunger that extends between the first and second chambers.

Another example embodiment includes a piston cooling nozzle device for controlling a flow fluid used for cooling pistons in an internal combustion engine, comprising a fluid flow control device having a first chamber and a second chamber for housing fluid and configured to control the fluid flow between the first and second chambers, the fluid flow control device including a check valve between the first and second chambers to regulate fluid flow from the first chamber into the second chamber to open a fluid flow path to the piston cooling nozzle in response to one of an engine speed and an air pressure being above a threshold, wherein the fluid flow control device includes a clearance to bleed fluid from the second chamber into the first chamber to delay a closing of the fluid flow path in response to the one of the engine speed and the air pressure dropping from below the threshold.

In certain forms of the foregoing device, the fluid flow control device includes a plunger that is movable to selectively open and close the fluid flow path in response to the one of the engine speed and the air pressure being above and below the threshold. In certain forms, the plunger is normally biased to a closed position that closes the fluid flow path.

In certain forms, in response to the one of the engine speed and the air pressure dropping below the threshold, the fluid flow control device is configured such that the fluid in the second chamber bleeds through the clearance to maintain the fluid flow control device open for a period of time after the engine speed drops below the threshold. In certain forms, the fluid flow control device is passively controlled in response to fluid pressure that is based on engine speed.

In certain forms, in response to the one of the engine speed and the air pressure dropping below the threshold, the check valve is configured to close and substantially prevent fluid flow from the second chamber into the first chamber through the check valve. In certain forms, the plunger is movable to selectively open and close the fluid flow path in response to air pressure from one of the intake manifold and the exhaust manifold.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A piston cooling system for an internal combustion engine, comprising:

a reservoir from which fluid is fed;

a piston cooling nozzle (PCN) coupled to the reservoir and configured to direct the fluid fed from the reservoir for spraying the fluid onto a piston in the engine; and a fluid flow control device connecting the reservoir and the PCN, the fluid flow control device having a first chamber that opens to allow the fluid to pass from the reservoir to the PCN in response to at least one of an engine speed and an air pressure exceeding a first threshold, the fluid flow control device including a second chamber in fluid communication with the first chamber for receiving fluid fed from the first chamber through a check valve between the first and second chambers in response to the fluid flow control device being opened, wherein at least one of the fluid flow control device and the check valve includes a clearance to bleed fluid from the second chamber into the reservoir to delay a closing of the fluid flow control device for a predetermined period of time in response to the one of the engine speed and the air pressure dropping below the first threshold.

2. The system of claim 1, wherein the fluid flow control device includes a plunger that is movable to selectively open and close a fluid flow path between the reservoir and the PCN in response to the one of the engine speed and the air pressure being above and below the threshold.

3. The system of claim 2, wherein the plunger includes a base that separates the first and second chambers and the check valve is housed in the base.

4. The system of claim 3, wherein the plunger includes a stem extending from the base to a body that is spaced from the base, and the first chamber is defined between the body and the base.

5. The system of claim 4, wherein the plunger is housed in a passage between a main oil supply rifle and a PCN rifle of the internal combustion engine.

6. The system of claim 4, wherein the plunger is normally biased to a closed position that closes the fluid flow path.

7. The system of claim 6, wherein the plunger is movable from the closed position to an open position in response to a fluid pressure in the first chamber acting on the body that overcomes a force biasing the plunger to the closed position.

8. The system of claim 7, wherein fluid flows from the first chamber through the check valve and into the second chamber as the plunger moves from the closed position to the open position.

9. The system of claim 2, wherein the clearance is located around the plunger between the plunger and a wall around the plunger that extends between the first and second chambers.

10. The system of claim 1, wherein, in response to the one of the engine speed and the air pressure dropping below the first threshold, the fluid flow control device is configured such that the fluid in the second chamber bleeds through the clearance to maintain the fluid flow control device open for a period of time after the engine speed drops below the first threshold.

11. The system of claim 1, wherein the fluid flow control device is passively controlled in response to fluid pressure that is based on engine speed.

12. The system of claim 1, wherein, in response to the one of the engine speed and the air pressure dropping below the first threshold, the check valve is configured to close and substantially prevent fluid flow from the second chamber into the first chamber through the check valve.

13. The system of claim 1, wherein the clearance is located on the check valve and is a hole through the check valve having a predetermined size.

14. A piston cooling nozzle device for controlling a flow fluid used for cooling pistons in an internal combustion engine, comprising:

a fluid flow control device having a first chamber and a second chamber for housing fluid and configured to control the fluid flow between the first and second chambers, the fluid flow control device including a check valve between the first and second chambers to regulate fluid flow from the first chamber into the second chamber to open a fluid flow path to the piston cooling nozzle in response to one of an engine speed and an air pressure being above a threshold, wherein the fluid flow control device includes a clearance to bleed fluid from the second chamber into the first chamber to delay a closing of the fluid flow path in response to the one of the engine speed and the air pressure dropping from below the threshold.

15. The device of claim 14, wherein the fluid flow control device includes a plunger that is movable to selectively open and close the fluid flow path in response to the one of the engine speed and the air pressure being above and below the threshold.

16. The device of claim 15, wherein the plunger is normally biased to a closed position that closes the fluid flow path.

17. The device of claim 16, wherein the plunger is movable to selectively open and close the fluid flow path in response to air pressure from one of the intake manifold and the exhaust manifold.

18. The device of claim 14, wherein, in response to the one of the engine speed and the air pressure dropping below the threshold, the fluid flow control device is configured such that the fluid in the second chamber bleeds through the clearance to maintain the fluid flow control device open for a period of time after the engine speed drops below the threshold.

19. The device of claim 14, wherein the fluid flow control device is passively controlled in response to fluid pressure that is based on engine speed.

20. The device of claim 14, wherein, in response to the one of the engine speed and the air pressure dropping below the threshold, the check valve is configured to close and substantially prevent fluid flow from the second chamber into the first chamber through the check valve.

* * * * *